US005888151A

United States Patent [19]

Hayashi

[11] Patent Number: 5,888,151

[45] Date of Patent: Mar. 30, 1999

[54] WOUND GOLF BALL

[75] Inventor: Junji Hayashi, Chichibu, Japan

[73] Assignee: Bridgestone Sports Co., Ltd., Tokyo, Japan

[21] Appl. No.: 892,845

[22] Filed: Jul. 11, 1997

[30] Foreign Application Priority Data

Jul. 12, 1996 [JP] Japan ..... 8-203087

[51] Int. Cl.[6] ..... A63B 37/06

[52] U.S. Cl. ..... 473/363; 473/377

[58] Field of Search ..... 473/363, 364

[56] References Cited

U.S. PATENT DOCUMENTS 4,295,652 10/1981 Saito et al. ..... 473/356

4,337,946 7/1982 Saito et al. ..... 473/356

5,542,663 8/1996 Kato et al. ..... 473/363

*Primary Examiner*—George J. Marlo

*Attorney, Agent, or Firm*—Sughrue, Mion, Zinn, Macpeak & Seas, PLLC

[57] ABSTRACT

In a wound golf ball comprising a wound core and a cover, the wound core is formed by winding thread rubber on a center ball of multi-layer structure consisting of an inner sphere and an enclosure layer. The inner sphere has a diameter of 28–37 mm and a distortion of 3.5–10 mm under a load of 100 kg. The enclosure has a melting point higher than the cover molding temperature and a Shore D hardness of 40–75. The center ball has an outer diameter of 33–38 mm and a distortion of 2.5–6 mm under a load of 100 kg. Whether the head speed is high or low, an increased flight distance and improved feel are obtained.

16 Claims, 1 Drawing Sheet

WOUND GOLF BALL

BACKGROUND OF THE INVENTION

1. Field of the Invention

This invention relates to a wound golf ball having a center ball consisting of an inner sphere and an enclosure layer.

2. Prior Art

Wound golf balls are generally prepared in the prior art by winding a high elongation thread rubber around a liquid or solid center to form a thread rubber layer, and molding a cover stock of balata rubber or ionomer resin on the thread rubber layer.

As compared with two- and multi-piece solid golf balls, wound golf balls are superior in hitting feel and controllability, but inferior in flight distance upon full driver shots because of an increased spin rate and lofting trajectory. Attempts to reduce the spin rate and increase the flight distance of wound golf balls were made in JP-A 129072/1984 and JP-B 4104/1994 disclosing a center ball with an increased diameter. This proposal, however, suffers from the contradictory problem that making the large diameter center ball harder (higher hardness) exacerbates the feel of the ball and prevents the ball from being deformed sufficiently to travel long, especially upon full shots by low head speed players whereas making the large diameter center ball softer (lower hardness) exacerbates the restitution and flight performance of the ball.

No wound golf balls have been optimized in spin rate and satisfied the requirements of an increased flight distance and good feel upon driver shots at any head speed covering from high to low ranges. There is a desire to have such a golf ball.

The manufacture of wound golf balls includes a thread rubber winding step. Typically the center ball is frozen in order to prevent the center ball from deforming upon winding of thread rubber. An oily substance is usually blended in the center ball for facilitating freezing. The oily substance added, however, can reduce restitution and undesirably increase the temperature dependency of restitution. Additionally, the freezing treatment is a cumbersome step adding to the cost.

Therefore, an object of the invention is to provide a wound golf ball which can eliminate a cumbersome expensive center ball freezing treatment from the winding step to achieve a cost reduction and which is improved in flight performance and hitting feel whether the head speed is high or low.

SUMMARY OF THE INVENTION

The invention is directed to a wound golf ball comprising a wound core and a cover enclosing the wound core, the wound core comprising a center ball of multi-layer structure consisting of an inner sphere and an enclosure of at least one layer enclosing the inner sphere and thread rubber wound on the center ball. The inventor have selected the parameters such that the inner sphere has an outer diameter of up to 37 mm and a hardness corresponding to a distortion of 3.5 to 10 mm under an applied load of 100 kg, the enclosure has a melting point higher than the molding temperature of the cover and a Shore D hardness of at least 40°. The center ball has an outer diameter of 33 to 38 mm and a hardness corresponding to a distortion of 2.5 to 6 mm under an applied load of 100 kg. This selection gives the following advantages. (1) The large diameter center ball of multi-layer structure is effective for optimizing a spin rate. (2) Enclosing the soft inner sphere with the relatively hard enclosure improves restitution and yields the center ball having a sufficient hardness to withstand deformation upon winding. As a result, the conventional center ball freezing step which is cumbersome and expensive can be eliminated from the winding step. (3) Since the blending of oily substance in the center ball which is necessary for effective freezing is eliminated, the center ball is not reduced in restitution and the temperature dependency of the restitution is minimized. (4) The melting point of the enclosure higher than the cover molding temperature prevents the enclosure from melting upon molding of the cover at high temperature by heat compression molding, preventing any drop of restitution.

The advantages (1) to (4) cooperate in a synergistic manner, offering the following benefits. A spin rate is optimized to prevent the ball from lofting upward. The center ball having optimum hardness ensures improved restitution so that upon full shots with a driver at any head speed in low to high head speed ranges, a drastic increase of flight distance and an improvement in feel are achievable. The dependency of the ball performance on the head speed is reduced. The impact upon shots is reduced. Additionally, the elimination of the center freezing step from the winding step contributes to a saving of the manufacturing cost.

Accordingly, the present invention provides a wound golf ball comprising a wound core and a cover enclosing the wound core, the wound core comprising a center ball of multi-layer structure consisting of an inner sphere and an enclosure of at least one layer enclosing the inner sphere and thread rubber wound on the center ball, wherein the inner sphere has an outer diameter of up to 37 mm and a hardness corresponding to a distortion of 3.5 to 10 mm under an applied load of 100 kg, the enclosure has a melting point higher than the molding temperature of the cover and a Shore D hardness of at least 40, and the center ball has an outer diameter of 33 to 38 mm and a hardness corresponding to a distortion of 2.5 to 6 mm under an applied load of 100 kg.

In one preferred embodiment, the cover is formed from a cover stock based on a thermoplastic resin by heat compression molding the cover stock on the wound core. The enclosure has a melting or softening point higher than the melting or softening point of the cover stock. Alternatively, the cover is formed from a cover stock based on a non-thermoplastic resin by heat compression molding the cover stock on the wound core.

BRIEF DESCRIPTION OF THE DRAWINGS

These and further features of the present invention will be apparent with reference to the following description and drawings.

The sole FIGURE.

DETAILED DESCRIPTION OF THE INVENTION

Figure 1:
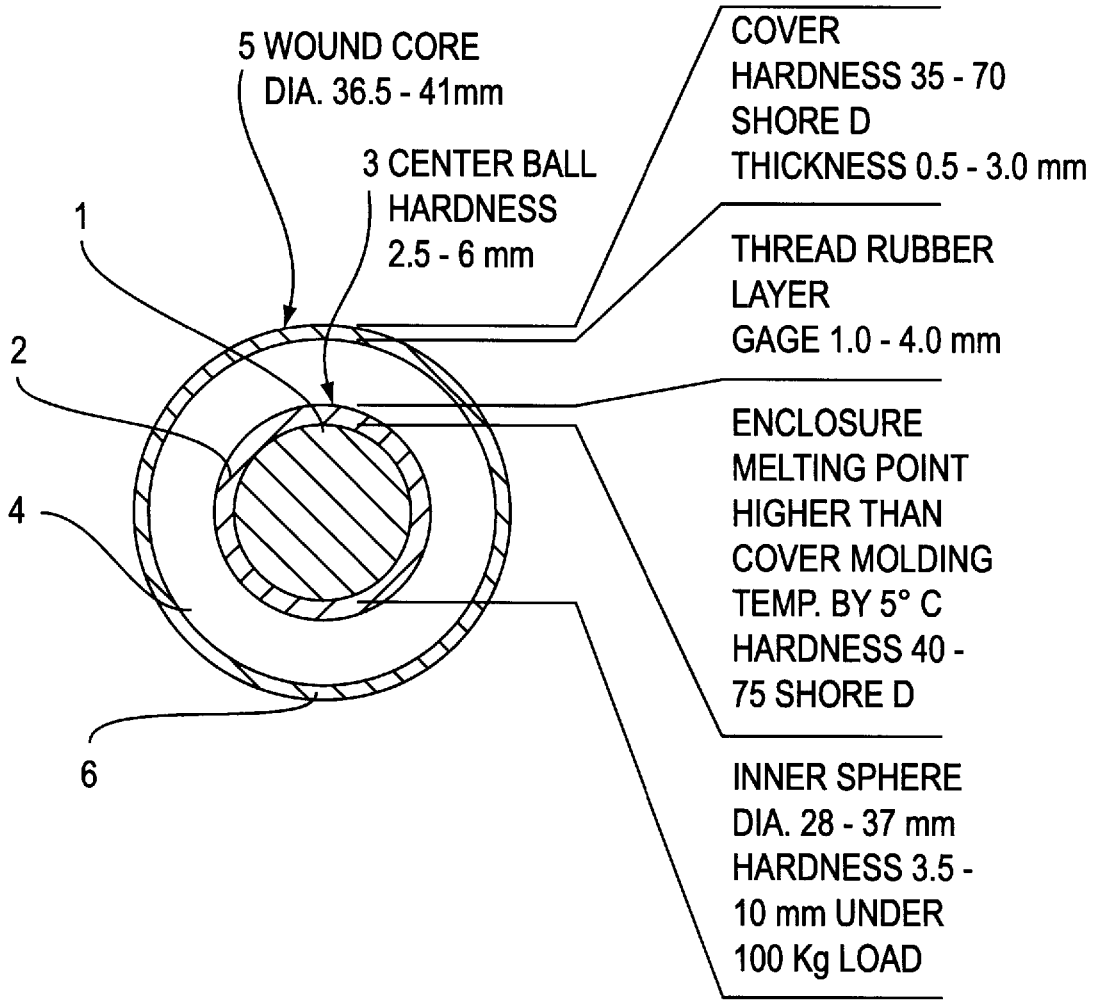
FIG. 1 is a schematic cross-sectional view of a wound golf ball according to one embodiment of the invention.

Referring to FIG. 1, a wound golf ball according to the invention is illustrated as comprising a wound core 5 and a cover 6 enclosing the wound core 5. The wound core 5 is comprised of a center ball 3 of multi-layer structure and a thread rubber layer 4 formed by winding thread rubber around the center ball 3. The center ball 3 is constructed as a multi-layer structure consisting of an inner sphere 1 and an enclosure 2 of at least one layer enclosing the inner sphere 1.

The inner sphere 1 has an outer diameter of up to 37 mm, preferably 28 to 36 mm. An outer diameter in excess of 37 mm means that the soft inner sphere is too large and inevitably requires the resilient thread rubber layer 4 to be thin with a resultant loss of resilience. The inner sphere has a hardness corresponding to a distortion of 3.5 to 10 mm, preferably 3.7 to 8 mm under an applied load of 100 kg. An inner sphere with a distortion of less than 3.5 mm under a load of 100 kg is too hard, resulting in greater impact upon shots. A distortion in excess of 10 mm means an inner sphere that is too soft which leads to poor restitution, greater deformations upon shots, and low durability.

The inner sphere is constructed of any well-known composition comprising an elastomer, typically cis-1,4-polybutadiene as a base component and other components by any well-known technique.

The enclosure 2 is at least one layer formed around the inner core 1. The enclosure has a melting point higher than the cover molding temperature at which the cover is heat compression molded. If the melting point of the enclosure is lower than the cover molding temperature, the resin of the enclosure melts upon molding of the cover, resulting in a drop of restitution. Where the cover stock is based on a thermoplastic resin, the melting point of the enclosure is preferably at least 5° C. higher than the cover molding temperature. The melting or softening point of the resin of the enclosure should preferably at least 5° C. higher than the melting or softening point of the cover stock although such a difference somewhat varies with a particular cover stock. Where the cover stock is based on a non-thermoplastic resin such as balata rubber, the melting point of the enclosure is preferably at least 5° C. higher than the cover molding temperature.

The enclosure 2 should have a Shore D hardness of at least 40, preferably 40 to 75. If the Shore D hardness is less than 40, an enclosure is too soft, is less resilient and requires freezing in the winding step, which in turn, requires to blend in the inner sphere an oily substance adversely affecting restitution.

Where the enclosure layer of the specified hardness is formed on the outer periphery of the inner sphere, the freezing step can be eliminated from the winding step. A restitution improvement and a cost reduction are expected. That is, a multi-layer structure center ball formed by enclosing a soft inner sphere with a relatively hard enclosure layer has a sufficient hardness to withstand any force applied upon thread winding. Without a need for freezing, the center ball is resistant to any deformation upon winding. The elimination of the freezing step dispenses with the blending of an oily substance in the center ball which is necessary in the prior art. Then the drop of restitution of the center ball by the oily substance is avoided and the temperature dependency of restitution is reduced. Usually the enclosure layer has a gage of about 0.5 to 5.0 mm.

The enclosure layer can be formed by injection molding a well-known material around the inner sphere. The resins of which the enclosure layer is formed include polyester thermoplastic elastomers such as Hytrel 4767 and 5557 (trade name, manufactured by Toray-duPont K.K.) and flexible nylon such as Glylux N-1200 (trade name, manufactured by Dai-Nihon Ink Chemical Industry K.K.).

The center ball 3 consisting of the inner sphere 1 and the enclosure layer 2 has an outer diameter of 33 to 38 mm, preferably 33.5 to 37 mm. With a center ball diameter of less than 33 mm, the spin reducing effect of an enlarged center diameter is not fully exerted and flight performance is deteriorated. A center ball diameter of more than 38 mm inevitably requires the resilient thread rubber layer to be thin, leading to poor restitution.

Also the center ball has a hardness corresponding to a distortion of 2.5 to 6 mm, preferably 3 to 5.5 mm under an applied load of 100 kg. A center ball with a distortion of less than 2.5 mm is too hard and invites greater impacts upon shots and hence, poor feel. A distortion in excess of 6 mm means a too soft center ball which leads to poor restitution and must be frozen upon thread winding.

The thread rubber layer 4 is formed by winding thread rubber around the center ball 3 under high tension. The thread rubber layer usually has a gage of 1.0 to 4.0 mm, especially 1.5 to 3.5 mm. Any conventional winding technique may be used. No particular limits are imposed on the composition, specific gravity and dimensions (including thickness) of thread rubber. Any of commonly used thread rubbers may be selected. By winding thread rubber around the center ball 3 to form the thread rubber layer 4, there is obtained the wound core 5 which preferably has a diameter of 36.5 to 41 mm, more preferably 38 to 40.5 mm.

Finally, the wound core 5 is enclosed with the cover 6. The molding temperature of the cover is lower than the melting point of the enclosure layer. The cover may be either a single layer or a multilayer structure. The hardness, gage, specific gravity and other factors of the cover may be properly adjusted within a wide range to attain the objects of the invention. Usually, the cover has a Shore D hardness of about 35 to 70 and a gage of about 0.5 to 3 mm.

The cover may be formed of any of well-known cover stocks commonly used in the manufacture of golf balls. Exemplary cover stocks include thermoplastic resins such as Himilan 1706 and 1605 (trade name, manufactured by Mitsui-duPont Polychemical K.K.), ionomer resins such as Surlyn 8120 (trade name, manufactured by E. I. duPont), and polyurethane elastomers such as Miractran E195 (manufactured by Nihon Miractran K.K.) alone or in admixture of two or more. Non-thermoplastic resins such as balata rubber are also useful. If desired, UV absorbers, antioxidants, dispersants (e.g., metal soaps) and other additives are added to the cover stock.

Whether the cover stock is a thermoplastic resin (such as ionomer resins) or a non-thermoplastic resin (such as balata rubber), heat compression molding is preferably employed in enclosing the wound core 5 with the cover 6. The heat compression molding procedure involves preforming a pair of hemispherical half cups from the cover stock, encasing the wound core in the half cups, and heat compressing at a temperature of about 100° to 170° C. for about 1 to 10 minutes in the case of thermoplastic resin base cover stocks and at a temperature of about 80° to 110° C. for about 5 to 20 minutes in the case of non-thermoplastic resin base cover stocks.

Since the melting point of the enclosure layer is higher than the cover molding temperature as previously mentioned, it never happens that the resin of the enclosure layer melts upon cover molding.

The wound golf ball of the invention may be formed in its cover surface with dimples by a well-known method. After molding, the ball surface may be subject to finish works including buffing, painting and stamping. The ball should have a weight, diameter and other parameters complying with the Rules of Golf, that is, a weight of not greater than 45.93 grams and a diameter of not less than 42.67 mm.

Since the wound golf ball of the invention is constructed as above, not only medium to high club head speed players, but also low club head speed players can take advantage of the improved flight performance of the wound golf ball. The low club head speed means that the head speed is less than 35 m/sec. when a driver (#W1) is used. Even players with a low club head speed, say about 35 m/sec. can get a satisfactory flight distance and pleasant feel from the wound golf ball of the invention because the head speed dependency of flight performance is very low.

In the wound golf ball of the invention, the multilayer structure center ball consisting of the inner sphere and the enclosure layer is adjusted in size and hardness so as to eliminate the cumbersome freezing step conventionally required in the winding step. The ball is improved in restitution. Whether a player swings at a high or low club head speed, the player will enjoy an increased flight distance and pleasant feel when striking the ball with a driver.

EXAMPLE

Examples of the invention are given below by way of illustration and not by way of limitation.

Examples 1–8 & Comparative Examples 1–4

Inner spheres were prepared by milling inner sphere-forming compositions as shown in Tables 1 and 2 in a roll mill and heat compression molding them at 155° C. for 5 minutes.

Next, enclosure-forming compositions as shown in Tables 1 and 2 were milled and injection molded over the inner spheres to form center balls. It is noted that Comparative Examples 1 to 3 used a solid center consisting of the inner sphere without the enclosure and Comparative Example 4 used a liquid center.

Thread rubber of the following composition was wound on the center balls by a conventional winding technique, obtaining wound cores.

| Thread rubber composition | Parts by weight |
|---|---|
| Polyisoprene rubber | 70 |
| Natural rubber | 30 |
| Zinc oxide | 1.5 |
| Stearic acid | 1 |
| Vulcanization accelerator | 1.5 |
| Sulfur | 1 |

Next, a cover stock of a composition as shown in Tables 1 and 2 was milled and molded into a pair of half cups. Each of the wound cores was encased in a corresponding pair of half cups, which were heat compression molded. The cover was formed by heat compression molding at 140° C. for 4 minutes in the case of ionomer resins (Examples 1–6 and Comparative Examples 1–3) and at 160° C. for 5 minutes in the case of urethane resin (Example 7). In the case of balata rubber (Example 8), the cover was formed by heat compression molding at 85° C. for 10 minutes and immersion vulcanization for 48 hours.

TABLE 1

| | | Example | | | | | | | |
|---|---|---|---|---|---|---|---|---|---|
| | | 1 | 2 | 3 | 4 | 5 | 6 | 7 | 8 |
| Inner sphere | Cis-1,4-polybutadiene | 100 | 100 | 100 | 100 | 100 | 100 | 100 | 100 |
| | Zinc acrylate | 18 | 22 | 27 | 11 | 22 | 27 | 27 | 18 |
| | Dicumyl peroxide | 1.2 | 1.2 | 1.2 | 1.2 | 1.2 | 1.2 | 1.2 | 1.2 |
| | Antioxidant | 0.2 | 0.2 | 0.2 | 0.2 | 0.2 | 0.2 | G.2 | 0.2 |
| | Zinc oxide | 5 | 5 | 5 | 5 | 5 | 5 | 5 | 5 |
| | Barium sulfate | 62.3 | 50.8 | 49.2 | 123.5 | 40.7 | 49.2 | 21.9 | 48.7 |
| Enclosure | Hytrel 4767 | | | 100 | | | 100 | 100 | |
| | Hytrel 5557 | | 100 | | | | | | |
| | Glylux N-120 | 100 | | | 100 | 100 | | | 100 |
| Cover | Type | ionomer | ionomer | ionomer | ionomer | ionomer | ionomer | urethane | balata |
| | Himilan 1706 | 50 | 50 | 50 | 50 | 50 | | | |
| | Himilan 1605 | 50 | 50 | 50 | 50 | 50 | | | |
| | Surlyn 8120 | | | | | | 100 | | |
| | Miractran E195 | | | | | | | 100 | |
| | Trans-1,4-polyisoprene | | | | | | | | 60 |
| | High styrene resin | | | | | | | | 20 |
| | Natural rubber | | | | | | | | 20 |
| | Zinc oxide | | | | | | | | 10 |
| | Titanium oxide | | | | | | | | 10 |
| | Stearic acid | | | | | | | | 1 |
| | Sulfur | | | | | | | | 1.5 |

TABLE 2

| | | Comparative Example | | | |
|---|---|---|---|---|---|
| | | 1 | 2 | 3 | 4 |
| Inner sphere | Cis-1,4-poly-butadiene | 100 | 100 | 100 | liquid center |
| | Zinc acrylate | 32.5 | 18 | 11.5 | |
| | Dicumyl peroxide | 1.2 | 1.2 | 1.2 | |
| | Antioxidant | 0.2 | 0.2 | 0.2 | |
| | Zinc oxide | 5 | 5 | 5 | |
| | Barium sulfate | 34.0 | 39.4 | 105.3 | |
| Enclosure | Hytrel 4767 | — | — | — | |
| | Hytrel 5557 | — | — | — | |
| | Glylux N-120 | — | — | — | |
| Cover | Type | ionomer | ionomer | ionomer | balata |
| | Himilan 1706 | 50 | 50 | 50 | |
| | Himilan 1605 | 50 | 50 | 50 | |
| | Surlyn 8120 | | | | |
| | Miractran E195 | | | | |
| | Trans-1,4-polyisoprene | | | | 60 |
| | High styrene resin | | | | 20 |
| | Natural rubber | | | | 20 |
| | Zinc oxide | | | | 10 |
| | Titanium oxide | | | | 10 |
| | Stearic acid | | | | 1 |
| | Sulfur | | | | 1.5 |

The trade names in Tables 1 and 2 have the following meaning.

Hytrel: thermoplastic polyester elastomer by Toray duPont K.K.

Glylux: flexible nylon by Dai-Nihon Ink Chemistry K.K.

Himilan: ionomer resin by Mitsui duPont Polychemical K.K.

Surlyn: ionomer resin by E. I. duPont

Miractran: polyurethane elastomer by Nihon Miractran K.K.

The thus obtained golf balls of Examples 1–8 and Comparative Examples 1–4 were examined by the following tests. The results are shown in Tables 3 and 4.

Hardness of inner sphere

Hardness was expressed by a distortion (mm) of the inner sphere under an applied load of 100 kg.

Flight performance

Using a swing robot, the ball was hit with No. 1 Wood (driver, #W1) at a head speed (HS) of 45 m/sec. and 35 m/sec. to measure a spin rate, carry, total distance and elevation angle.

Impact force

An accelerometer was attached to the back of a driver head. When the ball was hit with this driver at a head speed of 45 m/sec., the acceleration was measured as an impact force. The measurement was converted into a relative value based on 100 for Comparative Example 3 (wound Surlyn ball).

Hitting feel

The balls were examined for hitting feel by a panel of three professional golfers with a club head speed of about 45 m/sec. and three top class amateur women golfers with a head speed of about 35 m/sec. who actually hit the balls. The ball was rated "○" for very soft feel, "Δ" for ordinary soft feel, and "X" for hard feel.

TABLE 3

| | | Example | | | | | | | |
|---|---|---|---|---|---|---|---|---|---|
| | | 1 | 2 | 3 | 4 | 5 | 6 | 7 | 8 |
| Center construction | | 2 layers | 2 layers | 2 layers | 2 layers | 2 layers | 2 layers | 2 layers | 2 layers |
| Inner sphere | Diameter (mm) | 32.0 | 32.0 | 32.0 | 27.0 | 35.0 | 32.0 | 32.0 | 32.0 |
| | Hardness (mm) | 6.1 | 5.1 | 4.2 | 9.0 | 5.0 | 4.1 | 4.0 | 6.0 |
| Enclosure layer | Hardness (Shore D) | 70 | 55 | 47 | 70 | 70 | 47 | 47 | 70 |
| | m.p. (°C.) | 181 | 208 | 199 | 181 | 181 | 199 | 199 | 181 |
| | s.p. (°C.) | — | 188 | 160 | — | — | 160 | 160 | — |
| Center | Diameter (mm) | 36.0 | 36.0 | 36.0 | 33.0 | 37.0 | 36.0 | 36.0 | 36.0 |
| | Hardness (mm) | 4.2 | 4.5 | 3.7 | 5.0 | 4.5 | 3.7 | 3.7 | 4.3 |
| Cover | m.p. (°C.) | 91 | 91 | 91 | 91 | 91 | 82 | — | — |
| | s.p. (°C.) | 65 | 65 | 65 | 65 | 65 | 49 | 122 | — |
| | Hardness (Shore D) | 63 | 63 | 63 | 63 | 63 | 46 | 46 | 45 |
| #W1 HS = 45 m/s | Spin (rpm) | 2520 | 2560 | 2590 | 2640 | 2500 | 2840 | 2860 | 2890 |
| | Carry (m) | 210.4 | 209.6 | 210.1 | 209.0 | 210.6 | 206.8 | 206.3 | 206.5 |
| | Total distance (m) | 221.5 | 220.3 | 221.0 | 219.7 | 221.9 | 217.0 | 216.5 | 216.9 |
| | Elevation angle (°) | 11.0 | 11.1 | 11.0 | 11.2 | 11.0 | 11.3 | 11.4 | 11.4 |
| | Hitting feel | ○ | ○ | ○ | ○ | ○ | ○ | ○ | ○ |
| #W1 HS = 35 m/s | Spin (rpm) | 4010 | 4050 | 4110 | 4150 | 4000 | 4340 | 4370 | 4400 |
| | Carry (m) | 143.9 | 143.6 | 143.7 | 143.0 | 144.0 | 141.5 | 140.8 | 141.0 |
| | Total distance (m) | 157.0 | 156.8 | 156.4 | 155.9 | 157.2 | 153.7 | 152.7 | 153.1 |
| | Elevation angle (°) | 12.4 | 12.4 | 12.5 | 12.5 | 12.3 | 12.6 | 12.7 | 12.7 |
| | Hitting feel | ○ | ○ | ○ | ○ | ○ | ○ | ○ | ○ |
| Impact force | | 93 | 92 | 93 | 91 | 91 | 92 | 92 | 92 |

TABLE 4

| | | Comparative Example | | | |
|---|---|---|---|---|---|
| | | 1 | 2 | 3 | 4 |
| Center construction | | 1 layer | 1 layer | 1 layer | liquid center |
| Inner sphere | Diameter (mm) | — | — | — | |
| | Hardness (mm) | — | — | — | |
| Enclosure layer | Hardness (Shore D) | — | — | — | |
| | m.p. (°C.) | — | — | — | |
| | s.p. (°C.) | — | — | — | |
| Center | Diameter (mm) | 36.0 | 36.0 | 27.6 | 28.0 |
| | Hardness (mm) | 3.0 | 6.0 | 8.3 | — |
| Cover | m.p. (°C.) | 91 | 91 | 91 | — |
| | s.p. (°C.) | 65 | 65 | 65 | — |
| | Hardness (Shore D) | 63 | 63 | 63 | 45 |
| #W1 HS = 45 m/s | Spin (rpm) | 2700 | 2430 | 2800 | 3150 |
| | Carry (m) | 208.1 | 203.9 | 207.0 | 204.4 |
| | Total distance (m) | 218.8 | 215.0 | 218.0 | 214.8 |
| | Elevation angle (°) | 11.3 | 11.0 | 11.3 | 11.7 |
| | Hitting feel | X | ○ | Δ | ○ |
| #W1 HS = 35 m/s | Spin (rpm) | 4200 | 3970 | 4300 | 4720 |
| | Carry (m) | 141.6 | 139.5 | 141.8 | 139.7 |
| | Total distance (m) | 154.2 | 151.5 | 154.0 | 150.8 |
| | Elevation angle (°) | 12.5 | 12.2 | 12.6 | 12.9 |
| | Hitting feel | X | ○ | Δ | Δ |
| Impact force | | 110 | 90 | 100 | 102 |

Note that the softening point (s.p.) was measured by the Vicat softening point test of JIS K7206.

As seen from Tables 3 and 4, the ball of Comparative Example 1 using a large diameter, high hardness center (single layer) is not fully suppressed in spin, does not travel long especially at a low head speed (HS=35 m/s), and gives a hard feel. The ball of Comparative Example 2 using a large diameter, low hardness center has low spin susceptibility and soft hitting feel, but does not travel a long distance due to low restitution. Comparative Example 3 is a wound Surlyn ball using a conventional solid center which receives a high spin rate and travels short. Comparative Example 4 is a conventional wound balata ball which receives a high spin rate and travels short.

In contrast, the wound golf balls within the scope of the invention (Examples 1 to 8) travel a long distance at either high or low club head speeds (HS=45 or 35 m/s) and present a pleasant hitting feel and a low impact force upon shots.

Although some preferred embodiments have been described, many modifications and variations may be made thereto in the light of the above teachings. It is therefore to be understood that within the scope of the appended claims, the invention may be practiced otherwise than as specifically described.

I claim:

1. A wound golf ball comprising; a wound core and a cover enclosing the wound core, the wound core comprising a center ball of multi-layer structure consisting of an inner sphere and an enclosure of at least one layer enclosing the inner sphere, and thread rubber wound on the center ball, wherein, said inner sphere is constructed of a composition comprising an elastomer and containing no oily substance, and has an outer diameter of up to 37 mm, and a hardness corresponding to a distortion of 3.5 to 10 mm under an applied load of 100 kg, said enclosure is formed of a resin, and has a Shore D hardness of at least 40, said center ball has an outer diameter of 33 to 38 mm and a hardness corresponding to a distortion of 2.5 to 6 mm under an applied load of 100 kg, said cover is formed from a cover stock based on a thermoplastic resin, and said enclosure has a melting or softening point higher than the melting or softening point of the cover.

2. The wound golf ball of claim 1 wherein said cover is formed from a cover stock based on a thermoplastic resin by heat compression molding the cover stock on the wound core, and said enclosure has a melting or softening point higher than the melting or softening point of the cover stock.

3. The wound golf ball of claim 1 wherein said cover is formed from a cover stock based on a non-thermoplastic resin by heat compression molding the cover stock on the wound core.

4. The wound golf ball of claim 1, wherein said inner sphere has an outer diameter in a range of 28 to 36 mm.

5. The wound golf ball of claim 1, wherein said inner sphere has a hardness corresponding to 3.7 to 8 mm under an applied load of 100 kg.

6. The wound golf ball of claim 1, wherein said resin of said enclosure has a melting point of at least 5° C. higher than a molding temperature of said cover.

7. The wound golf ball of claim 1, wherein said enclosure has a Shore D hardness in the range of 40 to 75.

8. The wound golf ball of claim 1, wherein said thread rubber layer comprises wound thread rubber having a thickness in the range of 1.0 to 4.00 mm.

9. The wound golf ball of claim 1, wherein said enclosure has a thickness in the range of 0.5 to 5.0 mm.

10. A wound golf ball comprising; a wound core and a cover enclosing the wound core, the wound core comprising a center ball or multi-layer structure consisting of an inner sphere and an enclosure of at least one layer enclosing the inner sphere, and thread rubber wound on the center ball, wherein said inner sphere is constructed of a composition comprising an elastomer and containing no oily substance, and has an outer diameter of up to 37 mm, and a hardness corresponding to a distortion of 3.5 to 10 mm under an applied load of 100 kg, said enclosure is formed of a resin, and has a Shore D hardness of at least 40, said center ball has an outer diameter of 33 to 38 mm and a hardness corresponding to a distortion of 2.5 to 6 mm under an applied load of 100 kg, said cover is formed of a cover stock based on a non-thermoplastic resin, and said enclosure has a melting or softening point higher than 110° C.

11. The wound golf ball of claim 2, wherein said inner sphere has an outer diameter in the range of 28 to 36 mm.

12. The wound golf ball of claim 10, wherein said inner sphere has a hardness corresponding to 3.7 to 8 mm under an implied load of 100 kg.

13. The wound golf ball of claim 2, wherein said resin of said enclosure has a melting point at least 5° C. higher than a molding temperature of said core.

14. The wound golf ball of claim 10, wherein said enclosure has a Shore D hardness in the range of 40 to 75.

15. The wound golf ball of claim 10, wherein said thread rubber layer comprises a wound thread rubber having a thickness in the range of 1.0 to 4.0 mm.

16. The wound golf ball of claim 10, wherein said enclosure has a thickness in the range of 0.5 to 5.0 mm.

* * * * *